US009869441B2

(12) United States Patent
Woodward

(10) Patent No.: US 9,869,441 B2
(45) Date of Patent: Jan. 16, 2018

(54) HYBRID OPTICS LED HEADLAMP

(71) Applicant: Magna International Inc., Aurora (CA)

(72) Inventor: Ronald O. Woodward, Yorktown, VA (US)

(73) Assignee: Magna International Inc., Aurora, Ontario (CA)

( * ) Notice: Subject to any disclaimer, the term of this patent is extended or adjusted under 35 U.S.C. 154(b) by 0 days.

(21) Appl. No.: 14/936,148

(22) Filed: Nov. 9, 2015

(65) Prior Publication Data

US 2016/0061400 A1 Mar. 3, 2016

Related U.S. Application Data

(63) Continuation of application No. 14/110,030, filed as application No. PCT/US2012/032467 on Apr. 6, 2012, now Pat. No. 9,182,094.

(60) Provisional application No. 61/516,798, filed on Apr. 7, 2011.

(51) Int. Cl.
*F21S 8/10* (2006.01)

(52) U.S. Cl.
CPC ..... *F21S 48/1323* (2013.01); *F21S 48/1104* (2013.01); *F21S 48/1109* (2013.01); *F21S 48/1159* (2013.01); *F21S 48/1163* (2013.01); *F21S 48/125* (2013.01); *F21S 48/1225* (2013.01); *F21S 48/1266* (2013.01); *F21S 48/13* (2013.01); *F21S 48/137* (2013.01); *F21S 48/1358* (2013.01); *F21S 48/1364* (2013.01)

(58) Field of Classification Search
CPC ..... F21S 48/1323; F21S 48/1109; F21S 48/1225; F21S 48/1364; F21S 48/1159; F21S 48/1104; F21S 48/125; F21S 48/1266; F21S 48/13; F21S 48/1358; F21S 48/137; B64D 47/02; B63B 45/00; B61D 29/00
See application file for complete search history.

(56) References Cited

U.S. PATENT DOCUMENTS

| | | | | |
|---|---|---|---|---|
| 1,533,615 | A | 4/1925 | Schwartz | |
| 1,642,917 | A | 9/1927 | Zimmermann et al. | |
| 5,313,379 | A | 5/1994 | Lemons et al. | |
| 5,954,427 | A * | 9/1999 | Campos | F21S 48/24 362/297 |
| 6,926,432 | B2 | 8/2005 | Rodriguez Barros et al. | |
| 7,264,387 | B1 | 9/2007 | McCarter et al. | |

(Continued)

FOREIGN PATENT DOCUMENTS

| | | |
|---|---|---|
| DE | 2644385 A1 | 4/1978 |
| EP | 1970617 A1 | 9/2008 |

(Continued)

*Primary Examiner* — Elmito Breval
*Assistant Examiner* — Fatima Farokhrooz
(74) *Attorney, Agent, or Firm* — Harness, Dickey & Pierce, P.L.C.

(57) ABSTRACT

This invention provides an optical system that collects 100% of the light emitted from the light source and effectively directs it into the desired beam pattern. This is achieved by a combination of different optical control methods including reflector and lens optics. The cost is controlled by a design that reduces the optical part count to 2 main components, which reduces manufacturing and assembling time and maintains proper alignment to the light source and system.

22 Claims, 6 Drawing Sheets

(56) References Cited

U.S. PATENT DOCUMENTS

| | | | | |
|---|---|---|---|---|
| 7,275,846 | B2 | 10/2007 | Browne et al. | |
| 7,635,206 | B2 * | 12/2009 | Huang | F21S 48/1159 362/249.02 |
| 8,573,803 | B2 | 11/2013 | Satou et al. | |
| 8,678,629 | B2 * | 3/2014 | Ishida | F21S 48/1159 362/296.01 |
| 2004/0184280 | A1 | 9/2004 | Ishida et al. | |
| 2005/0018428 | A1 | 1/2005 | Harvey | |
| 2008/0117327 | A1 | 5/2008 | Nishizawa et al. | |
| 2008/0225540 | A1 | 9/2008 | Tsukamoto et al. | |
| 2008/0285297 | A1 | 11/2008 | Ishida | |
| 2008/0316760 | A1 * | 12/2008 | Schug | F21S 48/115 362/516 |
| 2010/0123881 | A1 | 5/2010 | Sakata | |
| 2010/0246203 | A1 | 9/2010 | Chen et al. | |
| 2012/0051063 | A1 | 3/2012 | Holder | |
| 2012/0065760 | A1 * | 3/2012 | Yagi | G02B 27/0012 700/103 |
| 2013/0120988 | A1 * | 5/2013 | Woodward | F21V 13/04 362/235 |
| 2013/0215635 | A1 | 8/2013 | Boyd, Jr. et al. | |
| 2014/0063816 | A1 * | 3/2014 | Seki | F21V 5/04 362/309 |

FOREIGN PATENT DOCUMENTS

| | | | |
|---|---|---|---|
| EP | 2386795 | A1 | 11/2011 |
| JP | 2008226788 | A | 9/2008 |
| JP | 2008300154 | A | 12/2008 |
| JP | 2009129572 | A | 6/2009 |
| JP | 2010067380 | A | 3/2010 |

* cited by examiner

HYBRID OPTICS LED HEADLAMP

CROSS-REFERENCE TO RELATED APPLICATIONS

This application is a continuation of U.S. patent application Ser. No. 14/110,030 filed on Oct. 4, 2013, which is a U.S. National Stage of International Application No. PCT/US012/032467 filed on Apr. 6, 2012, and which claims the benefit of U.S. Provisional Application No. 61/516,798, filed on Apr. 7, 2011. The disclosure of the above applications are incorporated herein by reference.

FIELD OF THE INVENTION

The present invention relates to an opera house LED headlamp assembly having a reduced number of components.

BACKGROUND OF THE INVENTION

Current LED headlamps use a projector type lens or Reflector optics or closely coupled optics. These methods suffer from one or more problems such as low optical efficiency, high cost or poor beam pattern distribution. The present invention provides a LED headlamp assembly having a reduced number of components making the assembly smaller, easier to assemble and more cost effective.

SUMMARY OF THE INVENTION

This invention provides an optical system that collects substantially 100% of the light emitted from the light source and effectively directs it into the desired beam pattern. This is achieved by a combination of different optical control methods including reflector and lens optics. The cost is controlled by a design that reduces the optical part count to 2 main components, which reduces manufacturing and assembling time and maintains proper alignment to the light source and system.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
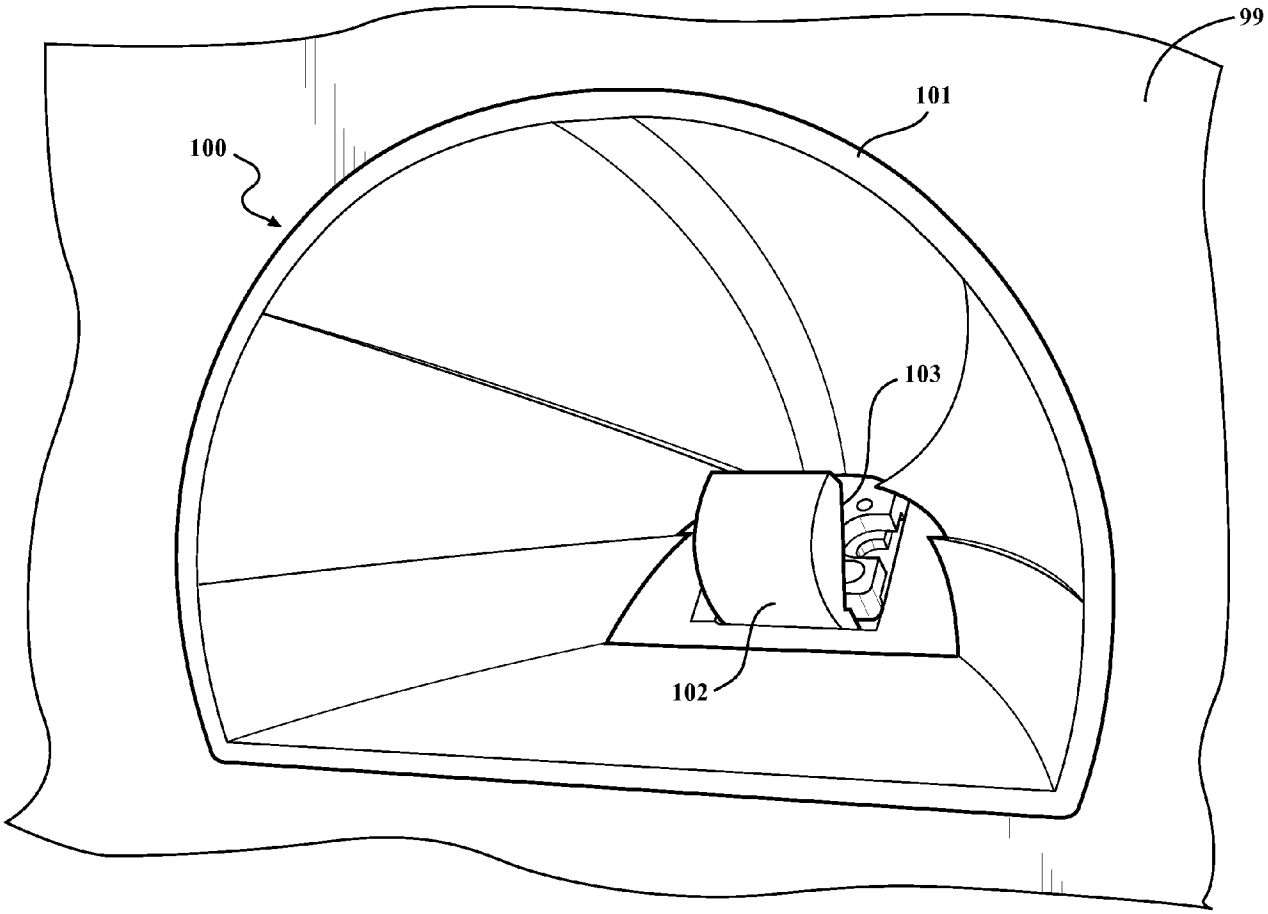
FIG. 1 is a Lamp Assembly 100 is comprised of Reflector 101 Lens 102 and LED 103.
Figure 2:
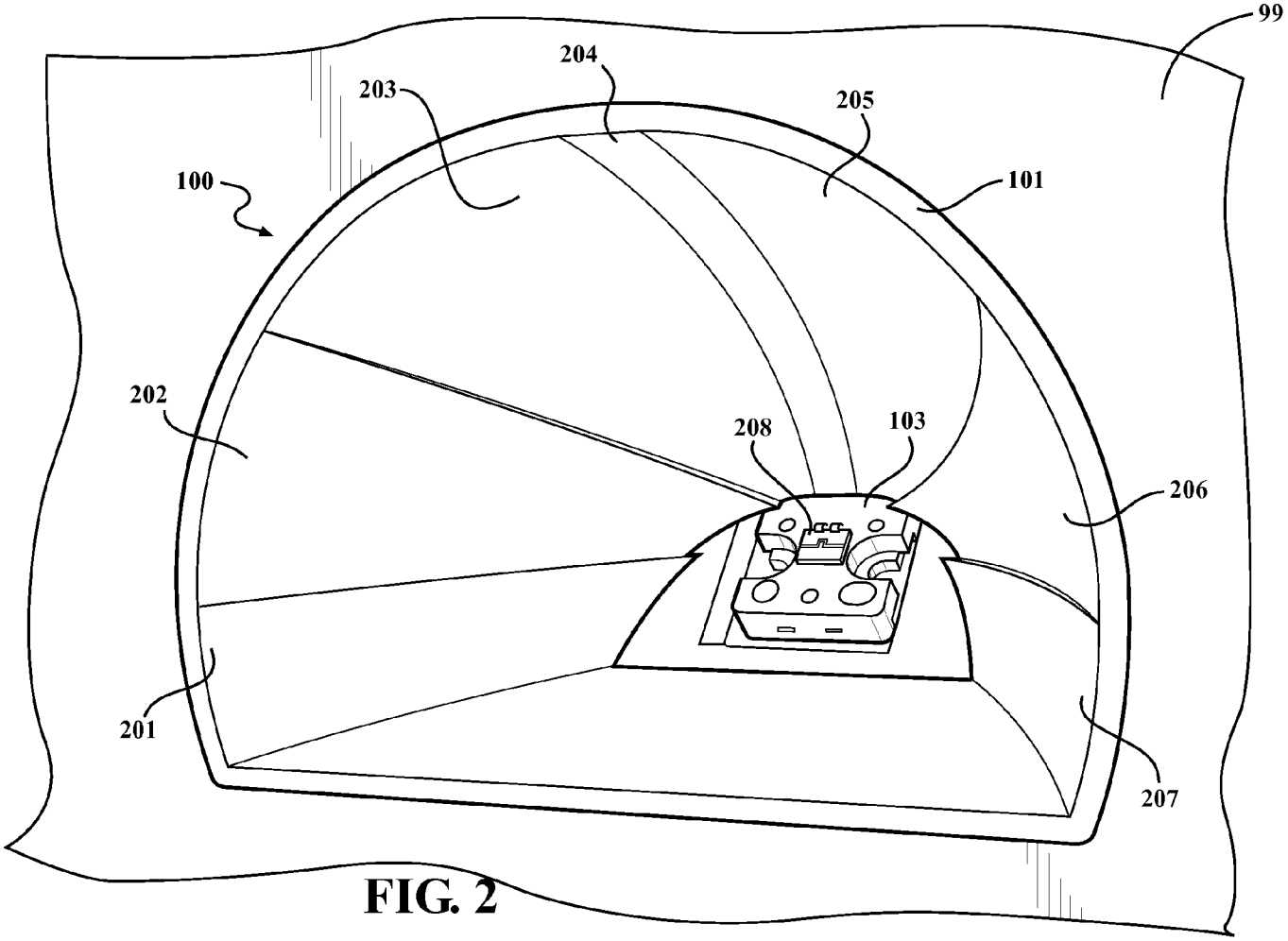
FIG. 2 Shows The lamp assembly 100 with the lens removed for a better view of the location of the LED 103 and light emitting surfaces 208 and identifies reflector sub segments 201, 202, 203, 204,205, 206 and 207.
Figure 3:
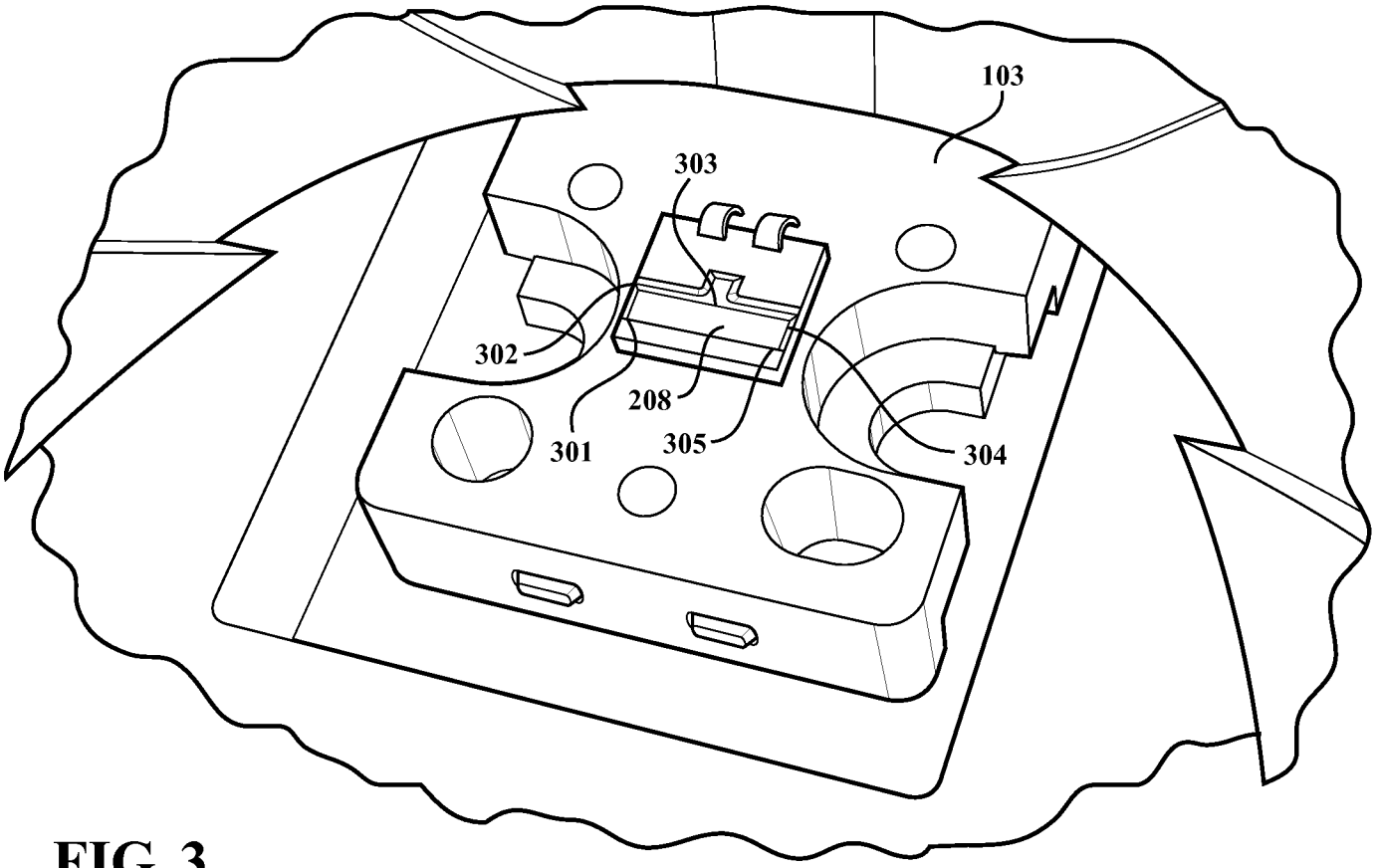
FIG. 3 shows a close up of LED 103 with light emitting surface 208 and identifies reflector subsegment focal points 301-305 as they relate to LED light emitting surface 208.
Figure 4:
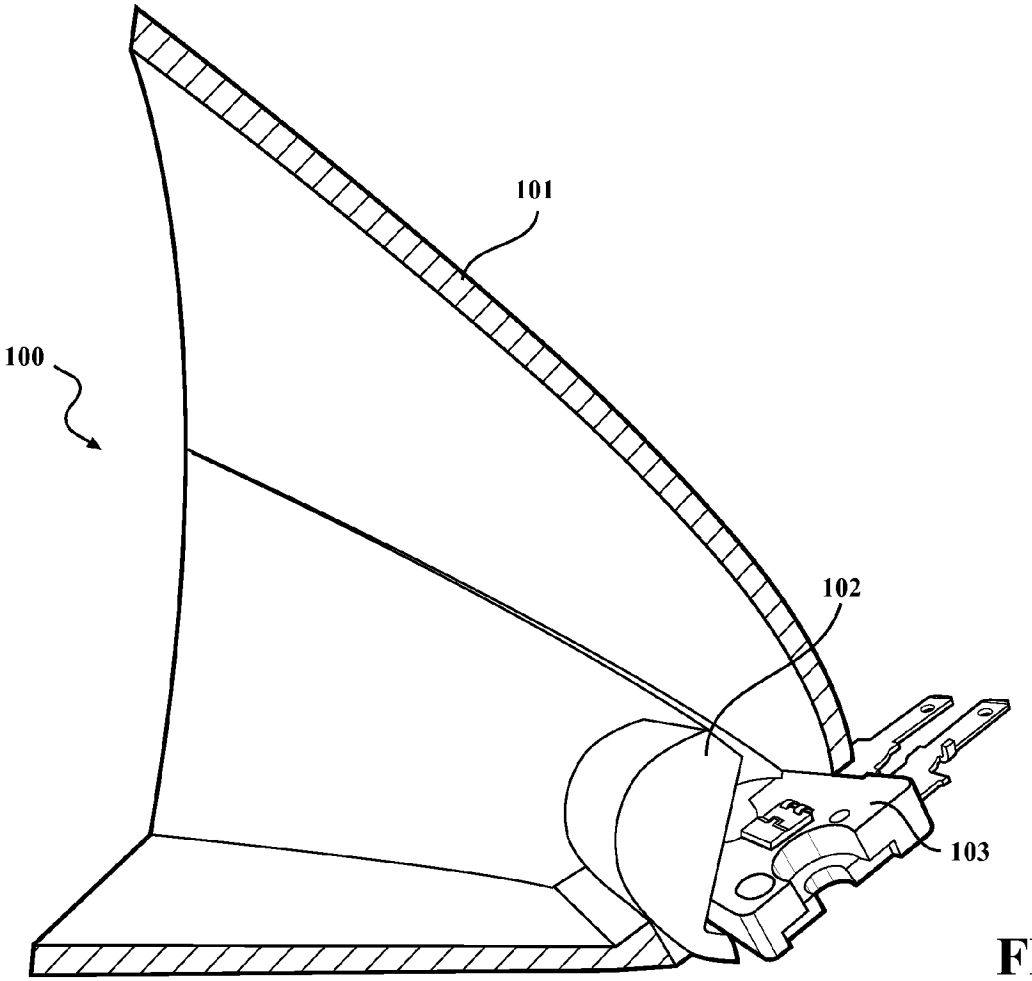
FIG. 4 shows Lamp Assembly 100 with half of Reflector 101 removed for better view of the relative location of lens 102, reflector 101, and LED 103.
Figure 5:
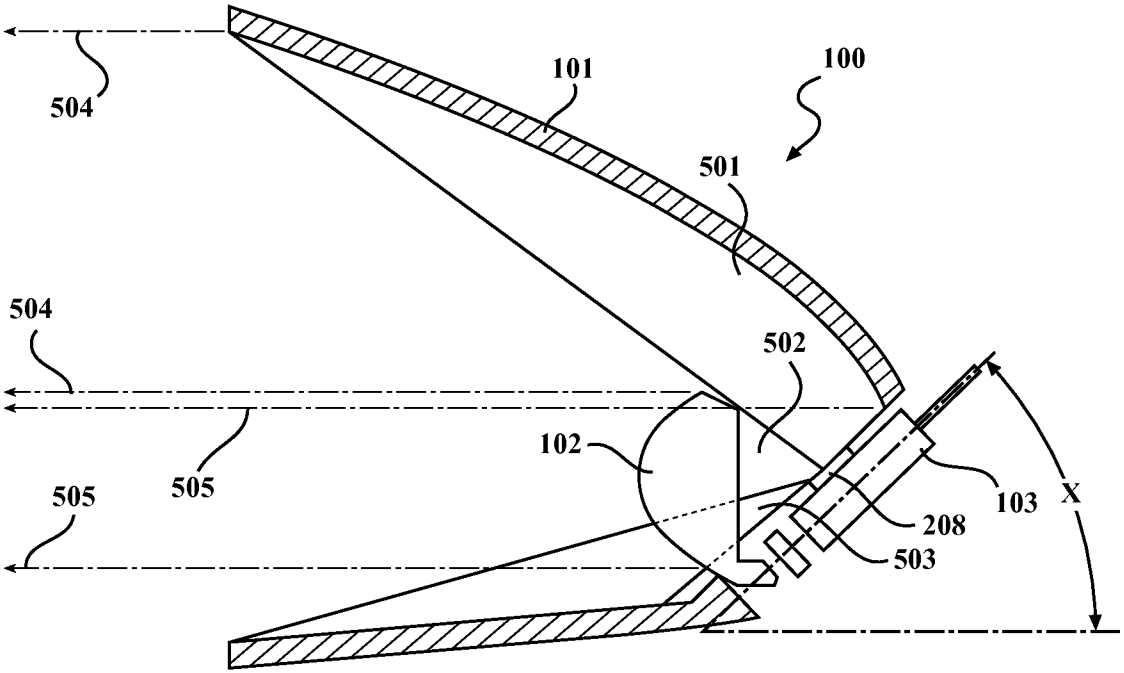
FIG. 5 shows a section through lamp Assembly 100 and identifies areas 501, 502 and 503 illuminated by LED light emission surface 208, and the controlled beam emission areas 504 and 505 and the relative positions of LED 103 Reflector 101 and Lens 102.
Figure 6:
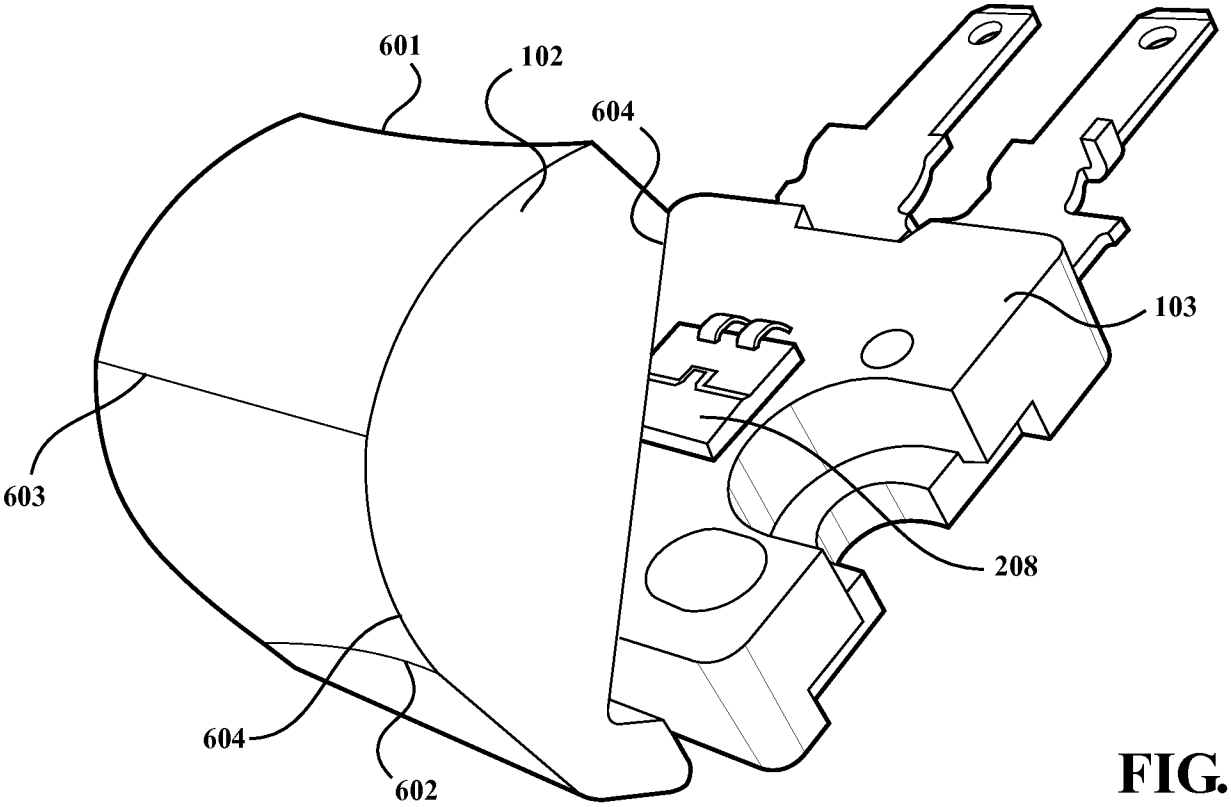
FIG. 6 shows a close up of Lens 102, LED 103, light emission area 208 and key features 601, 602, 603 and 604 of lens 102.

In FIG. 1, lamp Assembly 100 includes a housing 99, reflector 101, lens 102 and LED 103. FIG. 2 shows the lamp assembly 100 with the lens removed for a better view of the location of the LED 103 and light emitting surfaces 208 and identifies reflector sub segments 201, 202, 203, 204, 205, 206 and 207. FIG. 3 shows a close up of LED 103 its light emitting surface 208 and identifies reflector subsegment focal points 301, 302, 303, 304, 305 as they relate to LED light emitting surface 208. FIG. 4 shows lamp assembly 100 with half of reflector 101 removed for better view of the relative location of lens 102, reflector 101 and LED 103. FIG. 5 shows a section through lamp assembly 100 and identifies areas 501, 502 and 503 illuminated by LED light emission surface 208, and the controlled beam emission areas 504 and 505 and the relative positions of LED 103, reflector 101 and lens 102. FIG. 6 shows a close up of lens 102, LED 103, light emission area 208 and key features 601, 602, 603 and 604 of lens 102.

The present invention provides the ability to collect and control nearly 100% of the emitted light with very low levels of optical loss. This is achieved with the construction illustrated in FIG. 1. The lamp assembly 100 is composed of two optical components reflector 101, lens 102 and the light source LED 103. High optical efficiency is achieved with low losses by limiting light control to a single interaction with the reflector 101 approximately 85% reflectivity or passage through the lens 102 with only Fresnel losses at the entry and exit surfaces. Other lens interactions are loss-less total internal reflections off the sidewalls.

FIG. 2 identifies the seven unique reflector subsegments, including a first subsegment 201, second subsegment 202, third subsegment 203, fourth subsegment 204, fifth subsegment 205, sixth subsegment 206 and seventh subsegment 207 required to properly control the light impinging on them from the LED 103 light emission surface 208. LED 103 has light emission surface 208 shown close up in FIG. 3. Reflector first subsegment 201, second subsegment 202, third subsegment 203, fourth subsegment 204, fifth subsegment 205, sixth subsegment 206 and seventh subsegment 207 each have unique focalpoints identified as locations 301, 302, 303, 304, 305 at light emission surface 208. Subsegments are parabolas of revolution having their different focal points and the axis of revolution direction determined to achieve desired beam performance. With use of the identified focal point locations it is possible to keep all light rays controlled by the reflector first subsegment 201, second subsegment 202, third subsegment 203, fourth subsegment 204, fifth subsegment 205, sixth subsegment 206 and seventh subsegment 207 under the reflector segment axis allowing the construction of the required beam cutoff gradient.

Fourth reflector subsegment 204 is a cylindrical parabolic extrusion using focal point 303. Third reflector subsegment 203 uses focal point 302; fifth subsegment 205 uses focal point 304. First reflector subsegment 201 and sixth reflector subsegment 206 share focal point 305 and seventh reflector subsegments 207 and second reflector subsegment 202 share focal point 301.

FIG. 4 shows the LED 103 location, as it is inclined relative to reflector 101 and lens 102. This inclined angle orients the light emission surface 208 so it presents the maximum surface area and therefore maximum light concentration to the most distant part of reflector 101. This angle also eliminates light near the apex of the reflector that would be blocked by lens 102. It further improves the mix of optical images emitted by the reflector by presenting a smaller edge on view of the light-emitting surface that counter acts the magnification effect produced by close proximity of the reflector near the apex. The inclination of the LED 103 relative to the reflector 101 presents the maximum surface area and light concentration to a most distant part 506 of the reflector 101. A similar effect is produced in the light controlled by the lens. This rotation relative to the lens creates a mixture of thin and wide images that build an emission profiles having a bright edge near the top of the pattern and a dimmer edge near the bottom that produces a smoother beam pattern on the road. This is further illustrated in FIG. 5.

The light emitted by light emitting surface 208 can be first area 501 second area 502, third area 503 identified in FIG. 5. First area 501 illuminates reflector 101 that controls the light and forms beam 504. Without lens 102 the light in third area 503 would illuminate the floor of the reflector 101 and bounce up in to the glare areas of the beam not contribute to the useful performance of the lamp. Similarly the light in second area 502 would escape uncontrolled out of the front of the lamp. Much of the light would contribute to glare some portion would find its way to the road however the illumination provided would be feeble. By use of lens 102 this uncontrolled light can be collected and directed into the beam pattern adding substantially to the overall performance and at the same time eliminating the unwanted glare light. The tipping of LED 103 at an angle creates a hole in the light pattern emitted from reflector 101 that allows the use of lens 102 in such a way as to avoid blocking any significant portion of light from reflector 101.

Lens 102 is constructed as a cylindrical extrusion of a condensing lens profile. The lens 102 is a cylindrical extrusion of a condensing lens profile having one or more curved edges creating long edges and flat surfaces so that light emitted from said lens 102 has a wide beam pattern. This extrusion produces a wide spread pattern. Without adjustment the pattern would be distorted into a dog bone or bow tie shape putting unwanted light above horizontal and deeper into the pattern than desired. This is corrected by curving the edges of the extrusion 601 and 602 making the lens taller and flatter relative to the straight section 603. These changes having the effect to flatten the top and bottom of the pattern. Further some portion of the light that enters the optic will bounce off the sidewalls and then back into the lens before exiting. This reflected light would need more optical correction than needed by the lighting not bouncing off the sidewalls. Additional correction is achieved by adjusting the curvature of the side profiles 604 to provide the required correction.

This innovative optical configuration collects essentially 100% of the light while effectively shaping the beam pattern. Collected light bounces only once off the reflector keeping efficiency high. Use of multiple reflector segments with different focal points allows the required control of the beam cutoff. Light that would miss the reflector or bounce in undesired directions is collected by a closely spaced lens that collects the light into a useful pattern while not interfering with the light from the reflector. The light makes one pass through this lens also keeping efficiency high. The saddle shaped lens element creates a wide spread pattern while maintaining a flat beam cutoff.

The description of the invention is merely exemplary in nature and, thus, variations that do not depart from the essence of the invention are intended to be within the scope of the invention. Such variations are not to be regarded as a departure from the spirit and scope of the invention.

What is claimed is:

1. A headlamp assembly operable to project light as parallel rays in a forward direction, comprising:

a housing;

a light emitting device arranged in the housing and having a planar surface from which light is emitted, where the planar surface is oriented at substantially forty-five degrees in relation to the forward direction;

a lens arranged in the housing, the lens having a planar light receiving surface configured to receive a portion of the light emitted from the light emitting device and operates to direct the light in the forward direction, the light receiving surface of the lens is oriented at substantially forty-five degrees in relation to the planar surface of the light emitting device and oriented perpendicular to the forward direction; and a reflector having a parabolic reflecting surface configured to receive remaining portion of the light emitted from the light emitting device and reflect the remaining portion of the light in the forward direction, wherein the lens is arranged in relation to the reflector such that the remaining portion of the light reflected is not incident upon any surface of the lens, wherein the lens has a condensing profile formed in shape of a cylinder cut longitudinally to form the planar light receiving surface opposing a curved surface and the curved surface of the lens and the planar light receiving surface are truncated forming a truncated side between the curved surface and the planar light receiving surface, the truncated surface facing the parabolic reflecting surface of the reflector such that light directly from the light emitting device passing closest to the truncated surface of the lens is captured by the reflector and redirected into the beam.

2. The headlamp assembly of claim 1 wherein the lens is constructed as a cylindrical extrusion with a condensing lens profile.

3. The headlamp assembly of claim 1 wherein the flat surface of the lens is facing the light emitting device.

4. The headlamp assembly of claim 1 wherein the planar light receiving surface of the lens intersects with a plane aligned with the planar surface of the light emitting device and thereby receives light emitted substantially parallel to the planar surface of the light emitting device.

5. The headlamp assembly of claim 1 wherein the reflector is configured such that light is only reflected once off a surface thereof.

6. The headlamp assembly of claim 1 wherein the reflector is positioned around the lens and the light emitting device and has a reflecting surface with shape obtained by revolving a parabola ninety degrees around its axis.

7. The headlamp assembly of claim 1 wherein the reflector includes a plurality of segments, each segment shaped parabolic shape.

8. The headlamp assembly of claim 1 wherein the reflector having a plurality of segments, such that each segment having a different focal point on the planar surface of the light emitting device.

9. The headlamp assembly of claim 1 wherein the light emitting device is further defined as a light emitting diode.

10. The headlamp assembly of claim 1 wherein the light directly from the light emitting device passing closest to the truncated surface is directed to an outer edge of the reflector.

11. The headlamp assembly of claim 1 wherein the truncated surface is substantially parallel with portion of the parabolic reflecting surface directly opposed to and facing the truncated surface.

12. A headlamp assembly operable to project light in a forward direction along a horizontal plane, comprising:

a housing;

a light emitting device arranged in the housing and having a planar surface from which light is emitted, where the planar surface of the light emitting device is facing towards a horizontal plane aligned vertically above the light emitting device and forms substantially a forty-five degree angle with the horizontal plane;

a lens with a planar light receiving surface configured to receive a portion of the light emitted from the light emitting device and operates to direct the light as parallel rays in the forward direction, where the light receiving surface of the lens faces away from the forward direction and is oriented at substantially forty-five degrees in relation to the planar surface of the light emitting device; and a reflector arranged in the housing and configured to receive entire remaining portion of the light emitted from the light emitting device and reflect the remaining portion of the light as parallel rays in the forward direction, wherein the lens is arranged in relation to the reflector such that light emitted from the light emitting device has only a single interaction with either the lens or the reflector, wherein the lens is formed in shape of a cylinder cut in half along a longitudinal axis thereof, the lens having a flat surface opposing a curved surface and the curved surface of the lens is truncated on a side facing the parabolic reflecting surface of the reflector such that the truncated surface is substantially parallel with portion of the parabolic reflecting surface directly opposed to and facing the truncated surface.

13. The headlamp assembly of claim 12 wherein the lens is constructed as a cylindrical extrusion with a condensing lens profile.

14. The headlamp assembly of claim 12 wherein the flat surface of the lens is facing the light emitting device.

15. The headlamp assembly of claim 12 wherein the truncated surface of the lens is concave.

16. The headlamp assembly of claim 12 wherein the planar light receiving surface of the lens intersects with a plane aligned with the planar surface of the light emitting device and thereby receives light emitted substantially parallel to the planar surface of the light emitting device.

17. The headlamp assembly of claim 15 wherein the reflector is configured such that light is only reflected once off a surface thereof.

18. The headlamp assembly of claim 17 wherein the reflector having an aperture in which to receive the emitted from the light emitting device, wherein the reflector includes a reflecting surface with shape obtained by revolving a parabola ninety degrees around its axis and a substantially flat lower surface.

19. The headlamp assembly of claim 18 wherein the reflecting surface is partitioned into a plurality of segments having a parabolic shape.

20. The headlamp assembly of claim 19 wherein each segment of the plurality of segments having a different focal point on the planar surface of the light emitting device.

21. The headlamp assembly of claim 20 wherein the light emitting device is further defined as a light emitting diode.

22. The headlamp assembly of claim 16 wherein the reflector is a section of a truncated cone, such that light emitting device is arranged in truncated end of the cone and reflecting inner surface of the truncated cone extends from the plane aligned with the planar surface of the light emitting device.

* * * * *